United States Patent [19]

Schmidt et al.

[11] 3,949,676

[45] Apr. 13, 1976

[54] LOAD ACTUATED ELECTRO-IGNITION CIRCUIT SWITCH

[75] Inventors: Joseph A. Schmidt, Ridgecrest; W. James Stone, China Lake, both of Calif.

[73] Assignee: The United States of America as represented by the Secretary of the Navy, Washington, D.C.

[22] Filed: June 10, 1974

[21] Appl. No.: 478,008

[52] U.S. Cl. ..... 102/89; 89/1.814; 102/49.7; 244/122 AB

[51] Int. Cl.[2] ..... F42B 13/56

[58] Field of Search..... 102/89, 63, 49.7; 89/1.814; 244/3.12; 60/39.82 E, 256; 244/122 R, 122 A, 122 AB, 122 C, 122 D, 122 AE, 122 F, 122 G

[56] References Cited

UNITED STATES PATENTS

| | | | |
|---|---|---|---|
| 1,744,233 | 1/1930 | Locori | 102/63 |
| 2,805,622 | 9/1957 | Cammin-Christy | 102/89 X |
| 2,826,120 | 3/1958 | Lang et al. | 89/1.814 |
| 3,156,185 | 11/1964 | Hermann et al. | 102/89 X |
| 3,267,672 | 8/1966 | Craig et al. | 60/256 X |
| 3,347,039 | 10/1967 | Zeman | 60/256 X |
| 3,388,666 | 6/1968 | Walther | 102/49.7 |
| 3,633,510 | 1/1972 | Bernarden | 102/76 R |
| 3,776,140 | 12/1973 | Jones et al. | 102/70.2 R |

*Primary Examiner*—Samuel W. Engle
*Assistant Examiner*—Harold Tudor
*Attorney, Agent, or Firm*—R. S. Sciascia; R. Miller

[57] ABSTRACT

An igniter mechanism for a rocket motor utilized for towing a load or extracting an air crew member from a disabled aircraft. The mechanism operates whenever a sufficient force is exerted on the tow line to shear a pin allowing closure of the switch. Electrical energy coupled to the switch is conducted to a squib which ignites a charge to cause ignition of the rocket motor propellant. The electrical switch mechanism can only be actuated by a predetermined pulling force on the tow line thereby causing the electrical contacts to be brought positively together.

6 Claims, 3 Drawing Figures

LOAD ACTUATED ELECTRO-IGNITION CIRCUIT SWITCH

CROSS REFERENCE TO RELATED APPLICATIONS

Reference is made to Assignee's copending applications (Ser. No. 478,012, Ser. No. 478,010, now U.S. Pat. No. 3,893,365, Ser. No. 478,009, Ser. No. 478,011) filed of even date that relate to a rocket motor apparatus utilized for towing a load.

BACKGROUND OF THE INVENTION

1. Field of Invention

This invention relates to an electrical igniter mechanism for use in a rocket motor apparatus adapted to tow a load fastened to the rear end of a rocket motor by means of a tow line.

2. Background of Invention

Igniter switch mechanisms especially ones for use in rocket motors requires precise timing, in many instances, to positively ignite the propellant for powered rocket flight at a given time after a sequence of operations. This is especially the case where a requirement is to extract an air crew member, by powered rocket flight from an aircraft, by ignition of the rocket motor a predetermined time after its launch. These requirements demand exact timing to prevent either rocket malfunction or erratic powered flight of the rocket either of which could cause serious injury to the crew member or damage to the load.

Due to the need in recent years for lighter, simpler and more effective rocket motors for preforming a variety of tasks, for example carrying a line, towing a load or extracting a crew member to a safe distance from a disabled aircraft, it has been necessary to provide the rocket with a safe, simple economical ignition system that makes positive electric contact under all types of environmental conditions.

Prior art techniques have used relatively complex mechanical igniter features to provide safe operation since most rockets require only very low pull forces to cock and release a firing pin to ignite the rocket propellant. The devices are usually not activated by the tow line but by some other means remote from the rocket motor. To accomplish ignition may require the use of additional lanyards, powder trains or the like, which could affect ignition reliability. This is especially true in situations where there is a need for positive rocket ignition after a sequence of events taking place within a given time period during rocket motor launch and before rocket powered flight.

The present unique electrical ignition mechanism is a positive closing electrical switch device that depends on a predetermined pull being exerted by the tow line before ignition action can take place. The mechanism overcomes the inherent disadvantages of present complex mechanical rocket igniter systems by providing a mechanism that is simple, foolproof in operation and requires a minimum of parts

SUMMARY OF INVENTION

A feature of the invention is to provide a simple, foolproof, safe electrical ignition system for ignition of a rocket motor propellant only whenever a predetermined pull has been exceeded on a tow line.

The igniter mechanism is positioned in a housing at the nozzle end of the rocket motor and is actuated only by a pulling force on a tow line attached to the rocket. The tow line force is created by tow line stretch at time of rocket motor launch caused by the force of launch and the weight of the load attached to the tow line. When sufficient force is established a piston like element shears a pin allowing the closure of electrical contacts. Electrical energy is supplied from a power source to an electrically fired squib via the contacts and electrical leads. Squib combustion ignites a booster charge which in turn ignites the rocket propellant causing powered rocket flight.

Figure 1:
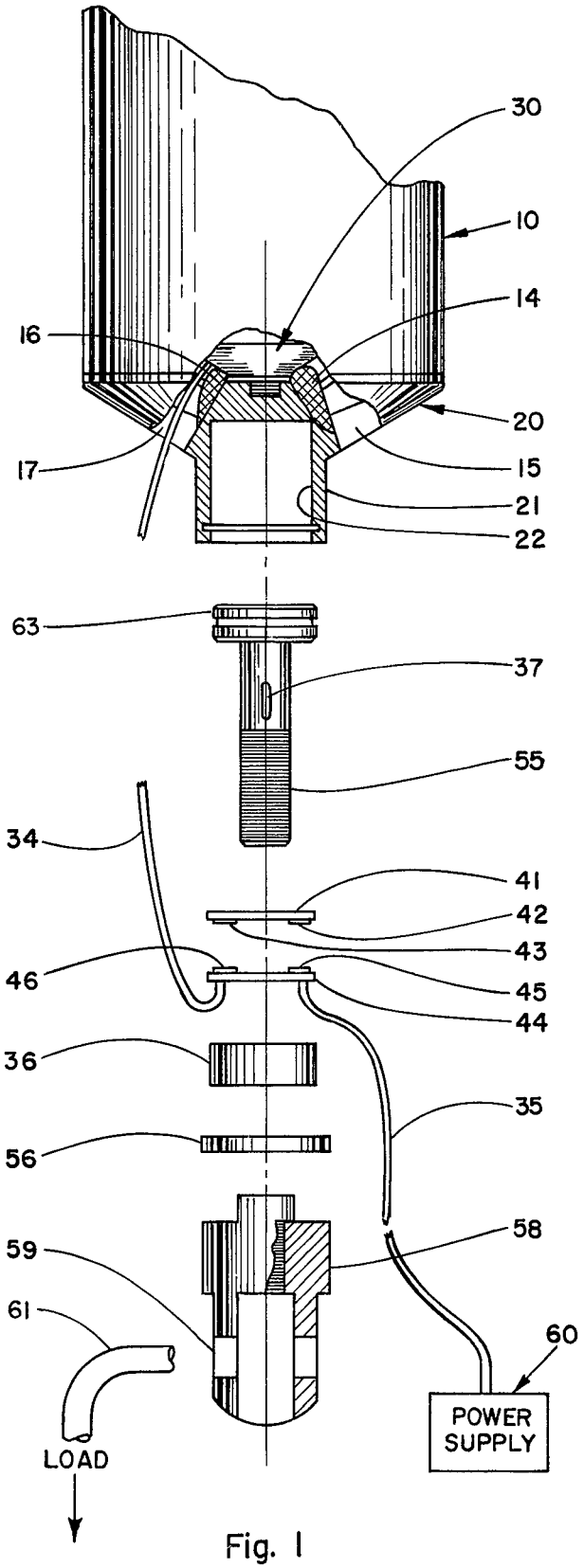
FIG. 1 illustrates an exploded view of the electrical igniter and rocket motor partly in cross section.
Figure 3:
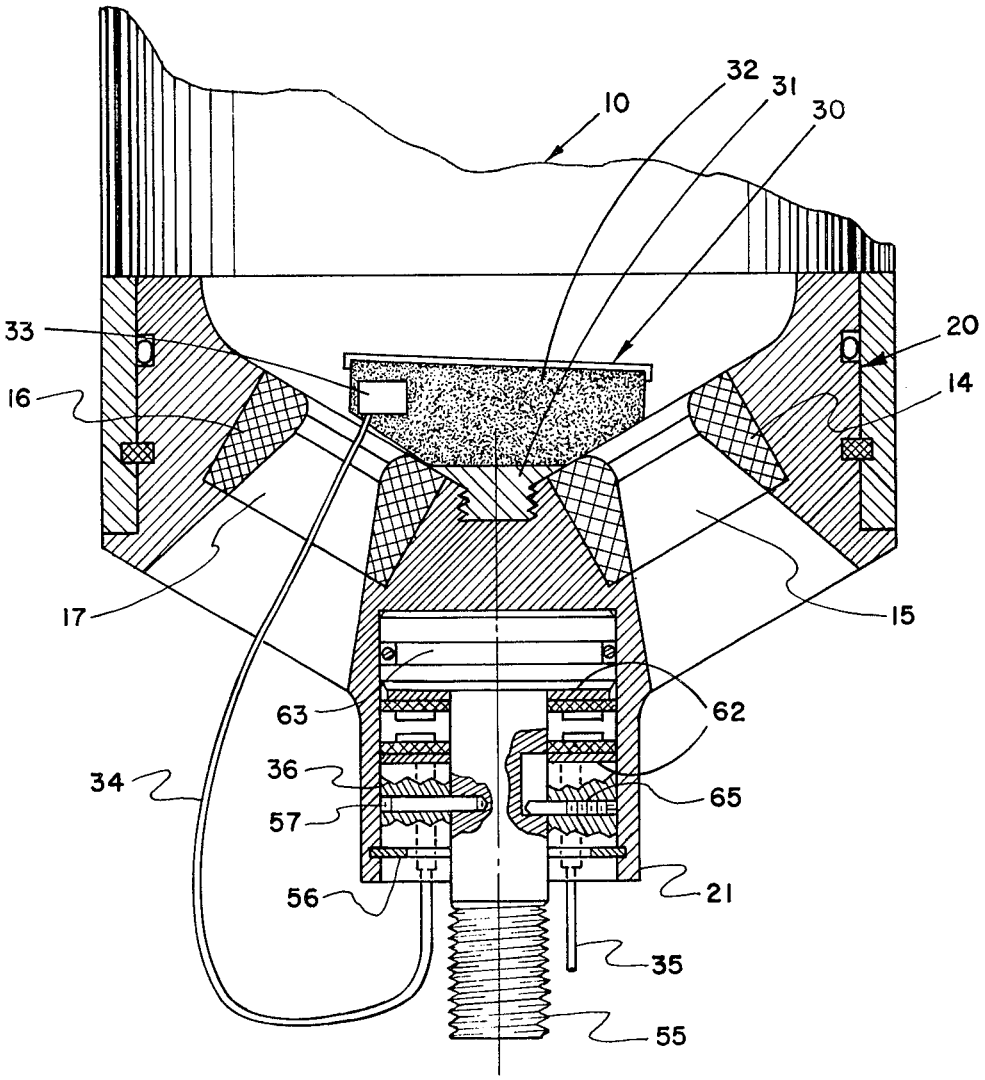
FIG. 3 is a cutaway view of the electrical ignitor assemblied in a rocket motor.

Referring now to drawings and in particular to FIG. 1, there is illustrated rocket motor 10 with an electrical igniter assembly to ignite propellant booster charge assembly 30. The igniter assembly is positioned in a boss 21 forming chamber 22 in rocket nozzle assembly 20. Rocket nozzles such as 15 and 17 are positioned symmetrically about the longitudinal axis of the rocket motor. Each rocket nozzle has a rocket nozzle insert such as 14 and 16 of suitable internal shape and material fastened in the throat of each nozzle. Stud member 55 is slidably positioned within chamber 22. A generally cylindrical piston head is fabricated on one end of stud body and the opposite end has external threads extending a substantial distance along the stud body. A machined slot 37 in the stud body cooperates with pin 65, best shown by reference to FIG. 3, to provide guiding and positioning of stud 55. A circumferential groove 63 in the piston head is fitted with an "O" ring for sealing and damping purposes.

Electrical contacts 42 and 43 are formed on contact wafer 41 and each electrical contact is formed in a crescent shape extending over substantial surface area of each wafer. Wafer 41 is fastened to a shoulder formed by the outer body of stud 55 and the lower surface of the piston head by means of adhesive 62. Contact wafer 44 is attached to collar 36 in like manner.

Figure 2:
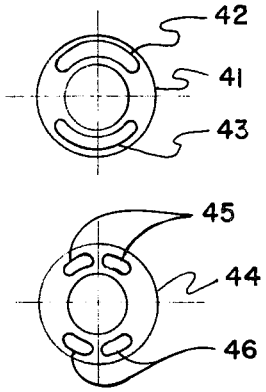
FIG. 2 illustrates a cross sectional view of details of the electrical switch assembled in a rocket motor.

A pair of electrical contacts 45 and 46, respectively, are formed on contact wafer 44 and each electrical contact is constructed in two portions, as shown in FIG. 2, for mating with contacts 42 and 43, respectively. Electrical leads 34 connect one contact of contact pair 45 and one contact of contact pair 46 to squib 33 which is in physical contact with booster charge 32. Container 30 is fastened by means of threads 31 to nozzle assembly 20. The other electrical contacts of contact pair 45 and 46, respectively, are connected by means of electrical conductors 35 to power supply 60.

Shear pin 57 extending through collar 36 and a portion of stud body 55 rigidly holds contact wafers 41 and 44 apart. A clip 56 bearing against an end surface of collar 36 holds elements of electrical switch assembly within chamber 22.

Shackle 58 having a forked lower section with holes 59 is held on stud 55 by means of a threaded portion. A tow line 61 is fitted through the forked section and held by means of a pin through holes 59. Tow line 61 extends to a load, now shown.

In operation rocket 10 is forcibly launched from a launcher mechanism, not shown. Tow line 61 stretches to carry a load thereby placing a pulling force on line 61 because of upward velocity of the motor and weight of the load. When this force exceeds a predetermined number of pounds shear pin 57 breaks allowing movement of stud 55 toward the direction of the pulling force on tow line 61. Contact wafers 41 and 44 are brought together completing the ignition circuit. Electrical current flows through squib 33 to ignite booster charge 32 to start combustion of the propellant within rocket motor 10.

Shear pin 57 is designed to have sufficient strength to prevent ignition by inadvertent pulling forces which may be placed on tow line 61 by persons handling or maintaining the rocket escape apparatus. Normally the pulling force must exceed an optimum value of approximately 700 to 1000 pounds in order to break pin 57. This value and the structural configuration of the switch allows the device to be used in a rocket motor without necessity for further safety features.

During rocket propellant burn the rocket carries the load at the end of a tow line 61 for a predetermined distance determined by the burn time and weight of the load. If a man or load from an air craft is attached to tow line 61, a personnel parachute can be deployed by some means such as a static line or the like or during rocket powered flight to allow a safe return to earth. The electrical leads 34 and 35 have no further use once powered rocket flight begins and are broken as the rocket travels beyond their length.

Although the preferred embodiment has been described, it will be understood that within the purview of this invention various changes may be made in the form, details proportions and arrangement of parts, the combination thereof and mode of operation, which generally stated consists in a device capable of carrying out the features set forth, as disclosed and defined in the appended claims.

What is claimed is:

1. A propellant ignition mechanism for a rocket motor utilized to tow a load by means of a tow cable fastened concentric with the center of the rocket motor and rearward of its nozzles comprising;

a cylindrical rocket motor housing having a nozzle portion formed with a rearward extending boss closing the rear word end of said housing;

a chamber formed by an axially disposed bore that is concentric with said rocket motor housing and which extends a substantial distance into the boss;

piston means in said chamber attached to a tow line and operative to move linearly rearwardly of the rocket motor after a predetermined force is exerted on said tow line;

electrical contact means operative to close after a predetermined rearward linear travel of said piston means; and power supply means electrically coupled to said electrical contact means to supply a current for igniting a rocket motor for powered flight.

2. The propellant ignition mechanism of claim 1 further comprising:

an electrically actuated explosive charge; and a booster charge ignited by said explosive charge for initiation of propellant burning.

3. The propellant ignitor mechanism of claim 1:

wherein said piston means has a substantially thick head portion and an elongated threaded stud portion extending from one surface of said head portion, said head portion having a sealing means extending around its circumferential edge.

4. The propellant igniter mechanism of claim 1:

wherein said electrical contact means has a fixed contact portion and a movable contact portion, said movable contact portion adapted to move as said piston means moves.

5. The propellant ignition mechanism of claim 1 further comprising:

guide pin means for causing piston means to move linearly without rotating.

6. The propellant ignition mechanism of claim 5 further comprising:

shear pin means fastened to hold said piston means from initial movement until sufficient rearward force is exerted on the tow line for shearing said pin thereby permitting rearward movement of said piston means.

* * * * *

UNITED STATES PATENT AND TRADEMARK OFFICE

CERTIFICATE OF CORRECTION

PATENT NO. : 3,949,676

DATED : April 13, 1976

INVENTOR(S) : Joseph A. Schmidt and W. James Stone

It is certified that error appears in the above-identified patent and that said Letters Patent are hereby corrected as shown below:

It is certified that error appears in the above-identified patent and that said Letters Patent is hereby corrected as shown below:

In the Abstract, on lines 4 and 5, change "the" to ---a---.

In column 1: on line 9, change "3,893,365" to ---3,893,367---; on line 23, change "given" to ---predetermined---; on line 33, change "preforming" to ---performing---; on line 51, change "given" to ---specific---; and on line 65, change "whenever" to ---when---.

In column 2: on line 2, insert ---the--- after "at"; on line 3, insert ---. This stretch is--- after "launch"; on line 14, change "illustrates" to ---is---; on line 16, change "illustrates" to ---is---; on line 21, change "illustrated" to ---shown a---; on line 29, change "stud" to ---A stud---; on line 32, insert ---the--- before "stud"; on line 40 change "Electrical" to ---A pair of electrical---; on line 40, insert ---a--- before "contact"; on line 45, insert ---an--- before "adhesive"; on line 46, change "Contact" to ---A contact---; on line 46, insert ---a--- after "to"; on line 46, insert ---a--- before "like"; on line 53, insert ---a--- after "to"; on line 54, insert ---a--- after"with"; on line 54, change "Container" to ---A container---; on line 58, insert ---a--- after "to"; on line 59, change "Shear" to ---A shear---; line 62, insert ---the--- before "electrical"; on line 64, change "Shackle 58" to ---A shackle 58,---; on line 65, insert ---,--- after "59".

In column 3: on line 4, insert ---the--- before "upward"; on line 6, change "allowing" to ---, which allows---; on line 16, insert ---,--- after "Normally"; on line 21, insert ---the--- after "without"; on line 22, insert ---,--- after "burn"; on line 23, delete "predetermined".

In column 4: on line 4, change "rear word" to ---rearward---.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*